US005488888A

United States Patent [19]

Kowal

[11] Patent Number: 5,488,888

[45] Date of Patent: Feb. 6, 1996

[54] METHOD OF FORMING BRIDGES IN TAMPER INDICATING CLOSURES

[75] Inventor: Timothy B. Kowal, Maumee, Ohio

[73] Assignee: Owens-Illinois Closure Inc., Toledo, Ohio

[21] Appl. No.: 48,638

[22] Filed: Apr. 19, 1993

[51] Int. Cl.[6] ..... B65D 41/34

[52] U.S. Cl. ..... 83/880; 83/30; 83/49; 83/54; 82/1.11; 82/47; 215/252; 264/154

[58] Field of Search ..... 83/862, 863, 864, 83/879, 880, 881, 882, 883, 884, 886, 887, 49, 54; 82/47, 1.11, 101; 215/252, 253; 264/154

[56] References Cited

U.S. PATENT DOCUMENTS

| | | | |
|---|---|---|---|
| 3,988,953 | 11/1976 | Bosley et al. | 83/30 X |
| 4,322,009 | 3/1982 | Mumford | 215/253 |
| 4,538,489 | 9/1985 | Takano | 82/71 |
| 4,545,496 | 10/1985 | Wilde | 215/252 |
| 4,595,110 | 6/1986 | Herr | 215/252 |
| 4,613,052 | 9/1986 | Gregory et al. | 215/252 |
| 4,658,976 | 4/1987 | Pohlenz | 215/252 |
| 4,721,218 | 1/1988 | Gregory et al. | 215/252 |
| 4,801,031 | 1/1989 | Barriac | 215/252 |
| 4,805,792 | 2/1989 | Lecinski, Jr. | 215/252 X |
| 4,934,227 | 6/1990 | Knorr | 82/1.11 X |
| 4,967,920 | 11/1990 | Dahl | 215/252 |
| 5,090,788 | 2/1992 | Ingram | 215/252 |

*Primary Examiner*—Rinaldi I. Rada
*Assistant Examiner*—Clark F. Dexter

[57] ABSTRACT

A tamper indicating closure comprising a base wall and a peripheral skirt having an internal thread adapted to engage the threads of a container wherein a tamper indicating band is provided on the skirt by a plurality of circumferentially spaced bridges. The band includes portions adapted to engage an annular bead on the container. The bridges are formed by using a primary knife having an interrupted cutting edge to produce a circumferential score in the side wall of the closure leaving spaced connectors or bridges followed by using a secondary knife having a continuous cutting edge to provide a continuous external score line and an accurately dimensional radial thickness of the bridges. In a preferred method and apparatus, the closures engage the successive primary and secondary knives and are moved such that the closures roll relative to the knives.

8 Claims, 5 Drawing Sheets

FIG.5
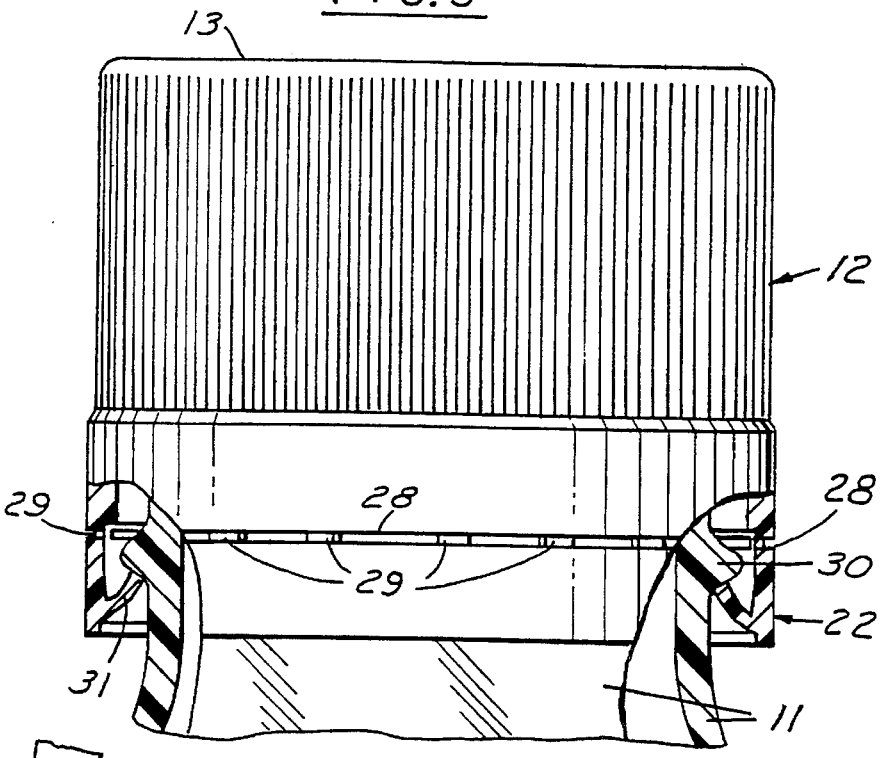
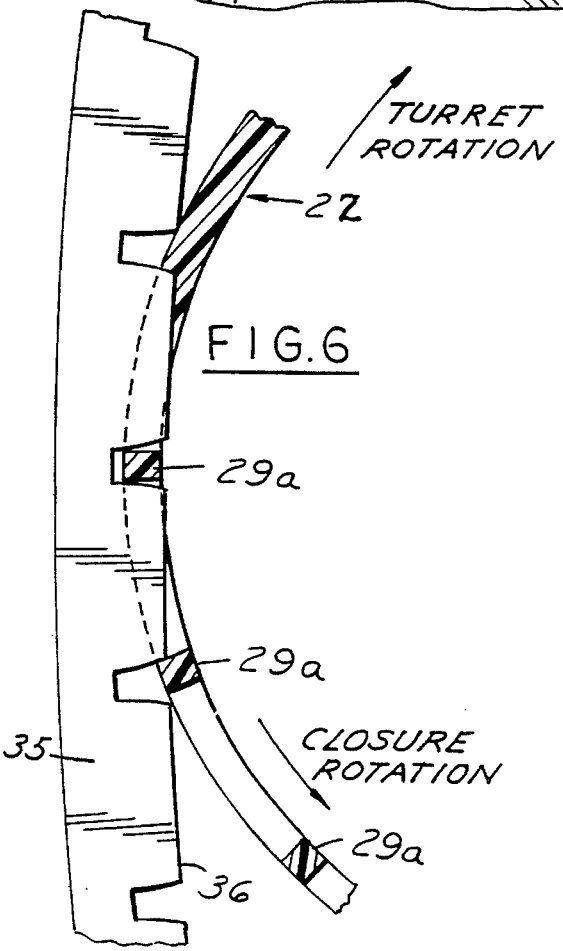
FIG.6
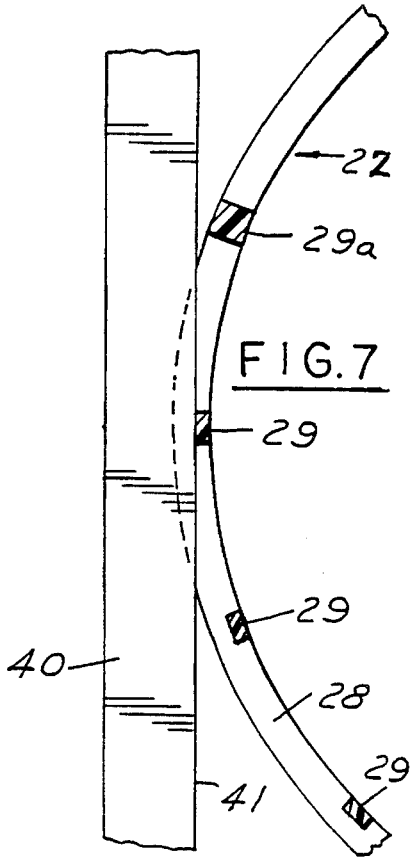
FIG.7

METHOD OF FORMING BRIDGES IN TAMPER INDICATING CLOSURES

BACKGROUND AND SUMMARY OF THE INVENTION

In one type of tamper indicating closure, it is conventional to mold circumferentially spaced bridges in order to define a tamper indicating band on the closure. Such construction requires costly more complex molds which also require maintenance. Typical patents showing such tamper indicating closures comprise U.S. Pat. Nos. 4,613,052, 4,721,218, 4,801,031, 5,090,246 and 5,090,788.

Another type of tamper indicating closure comprises utilizing an interrupted edged knife to produce bridges such as shown in U.S. Pat. No. 4,322,009.

In another type of tamper indicating closure, circumferentially spaced axial bridges are provided on the internal surface of the skirt of the closure and a continuous edged knife is applied from the exterior surface cutting through the wall of the closure and into the bridges. Such a construction also requires costly complex molds that require maintenance and necessitates relatively thin walls on the closures. A typical patent showing such a construction comprises U.S. Pat. No. 4,545,496.

Among the objectives of the present invention are to provide a tamper indicating closure on a molded plastic closure which does not require molded bridges; which can be made by relatively simple less costly molds; wherein the precise configuration of the bridges can be adjusted as desired; and wherein the bridges can be made at relatively high speeds and the desired configuration and strength of the bridges can be maintained; and wherein an improved method and apparatus insure accurately dimensional bridges.

In accordance with the invention, a tamper indicating closure comprises a base wall and a peripheral skirt having an internal thread adapted to engage the threads of a container wherein a tamper indicating band is provided on the skirt by a plurality of circumferentially spaced bridges. The band includes portions adapted to engage an annular bead on the container. The bridges are formed by using a primary knife having an interrupted cutting edge to produce a circumferential score in the side wall of the closure leaving spaced connectors or bridges followed by using a secondary knife having a continuous cutting edge to provide a continuous external score line and an accurately dimensional radial thickness of the bridges. In a preferred method and apparatus, the closures engage the successive primary and secondary knives and are moved such that the closures roll relative to the knives.

DESCRIPTION OF THE DRAWINGS

FIG. 5 is a part sectional view of the closure and container.

FIG. 6 and 7 are partly diagrammatic views showing the steps in the formation of the bridges.

DESCRIPTION

Figure 1:
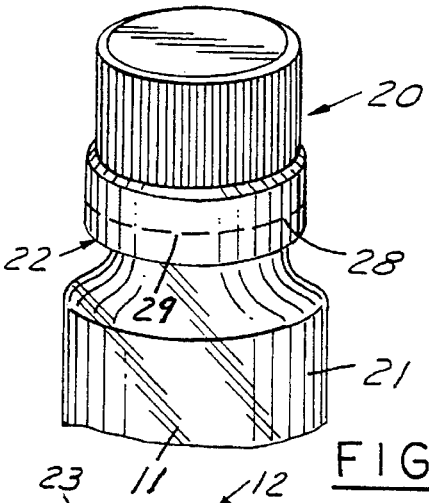
FIG. 1 is a fragmentary perspective view of a portion of a container embodying the invention.
Figure 4:
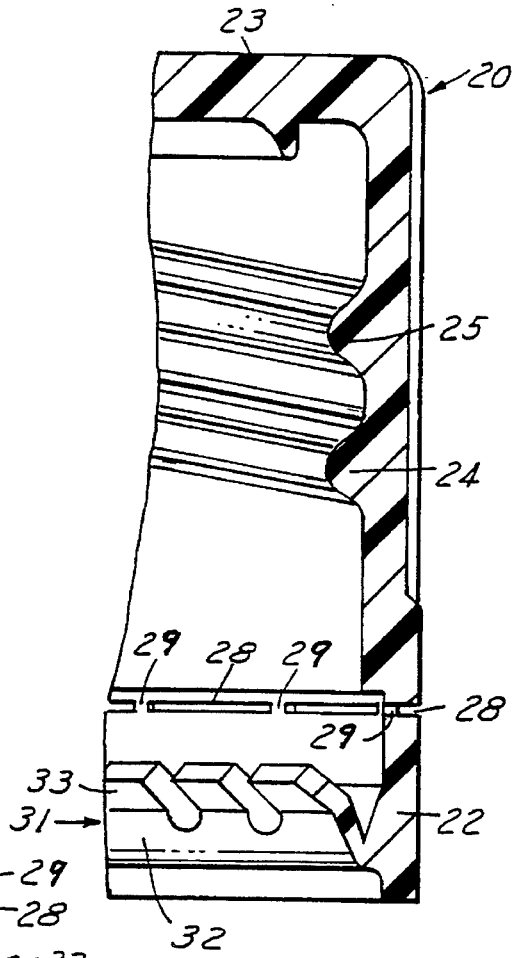
FIG. 4 is a fragmentary sectional view of a portion of the closure.
Figure 2:
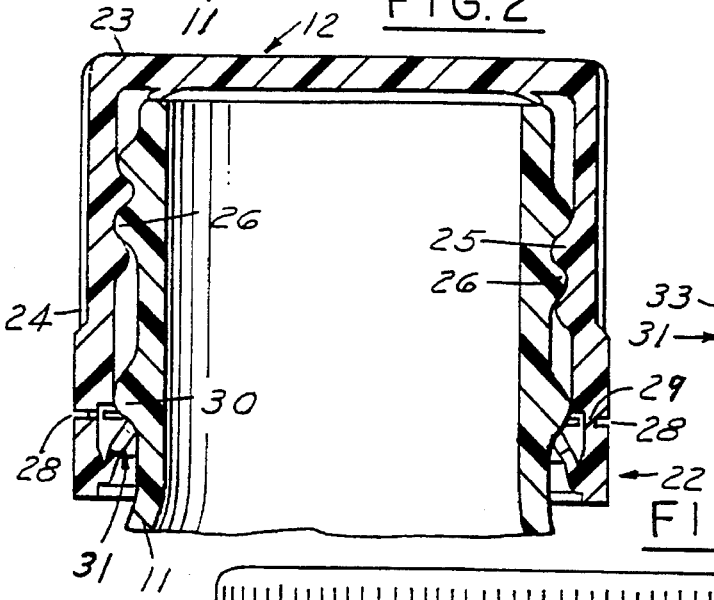
FIG. 2 is a fragmentary vertical sectional view through the container enclosure embodying the invention.
Figure 3:
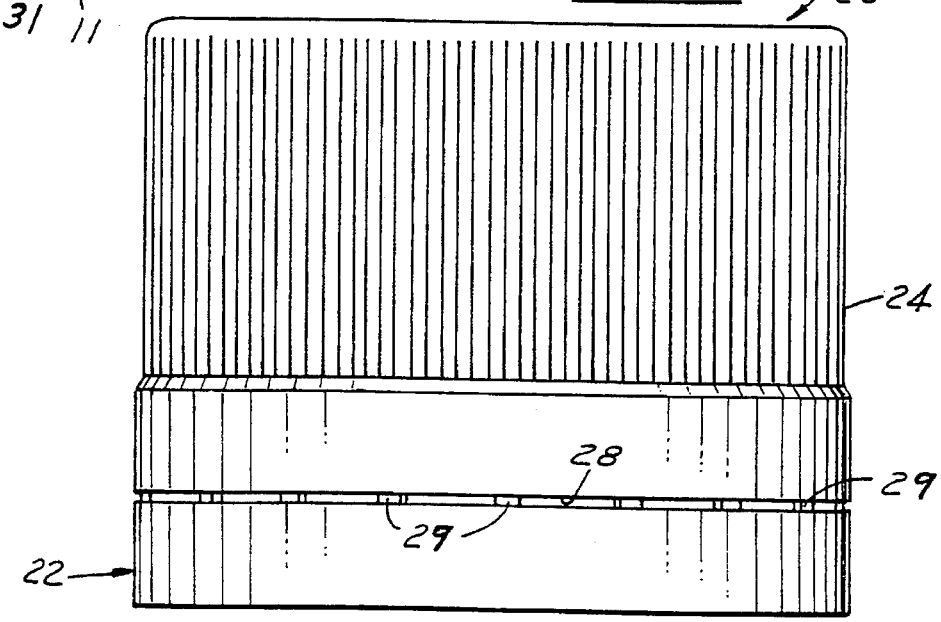
FIG. 3 is an elevational view of the closure.

Referring to FIGS. 1–5, the tamper indicating closure 20 is adapted to be applied to a container 21 and has a tamper indicating band 22. The closure 20 is made of plastic material such as polypropylene or polyethylene. The closure 20 includes a base wall 23 and peripheral skirt 24 having internal threads 25 adapted to engage external threads 26 on the container 21. A score line 28 extends radially inwardly and circumferentially of the lower portion of the skirt to form the tamper indicating band 22 having circumferentially spaced bridges 29. The tamper indicating band 22 includes interengaging means on the band which engages an annular bead or flange on the container to retain the closure on the container.

The interengaging means preferably comprises an annular flange 31 extending axially upwardly and inwardly from the tamper indicating band toward the base wall of the closure and including a first continuous annular flange portion 32 connected to the band by a hinge portion and a second portion 33, the free edges of which engage beneath bead 30 on the container 21 when the closure 20 is threaded onto the container 21. Such a tamper indicating closure in one form includes a plurality of segment portions and in another form includes a second continuous flange portion. The flange 31 in both forms is bent intermediate its ends so that the second portion 33 extends inwardly at a greater angle than the first continuous flange portion 32, all as shown in U.S. Pat. No. 5,090,788, incorporated herein by reference. Other types of tamper indicating bands may also be used as is well known in the art.

The bridges 29 are formed on the closure by rotating the closure relative to a series of knives. As shown in FIG. 6 a primary knife 35 is provided and has an interrupted edge 36 so that when the closure is rolled relatively to the knife 35, a plurality of preformed bridges **29*a* are provided. The closure is then rotated past a secondary knife 40 that has a continuous edge 41 that extends inwardly of the score formed by the primary knife 35 and cuts the preformed bridges 29*a* to form rectangular bridges in cross section which have a greater circumferential width than radial thickness. The continuous knife 40 also accurately dimensions the radial thickness of the bridges 29 as shown in FIG. 7. The relative movement of the closure and knives 35, 40 is such that the closure is moved along the edges 36, 41 of the knives 35, 40** and is simultaneously rotated about its axis so that the rate of movement and peripheral rate of rotation are substantially the same.

Figure 8:
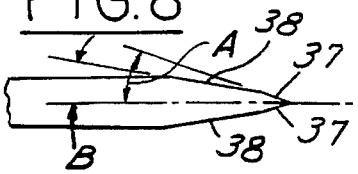
FIG. 8 is a fragmentary view of a portion of a primary knife utilized to form the bridges.
Figure 9:
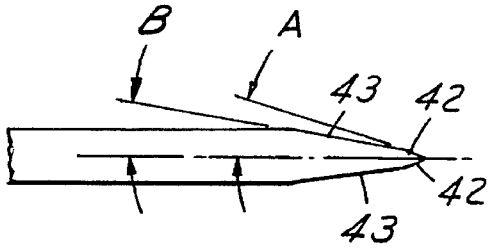
FIG. 9 is a fragmentary sectional view of a portion of a secondary knife for controlling the dimension of the bridges.

As shown in FIGS. 8 and 9 the knives 35, 40 preferably have their cutting edges 36, 41 formed with a cross section comprising a cutting edge that has tapered surfaces 37, 42 each of which forms an angle A with the central plane of the knife 35, 40 respectively and tapered surfaces 38, 43 outwardly of the knife edge forming a lesser angle B with the central plane of the knife 35, 40 respectively. In a typical example, knives 35, 40 have an axial thickness of 0.015 in., angle A=18° and angle B=9°.

Figure 10:
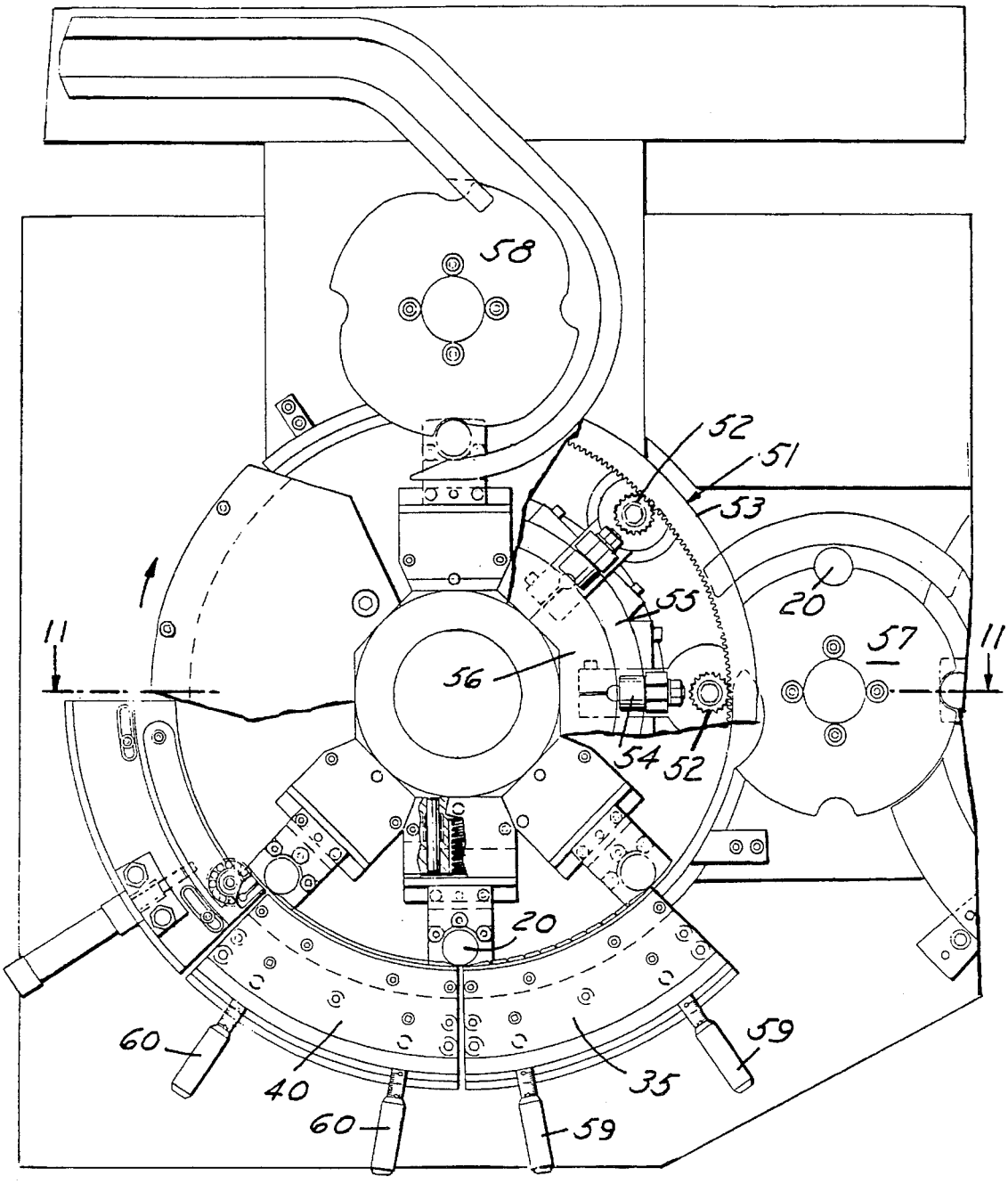
FIG. 10 is a plan view of an apparatus for forming the bridges.
Figure 11:
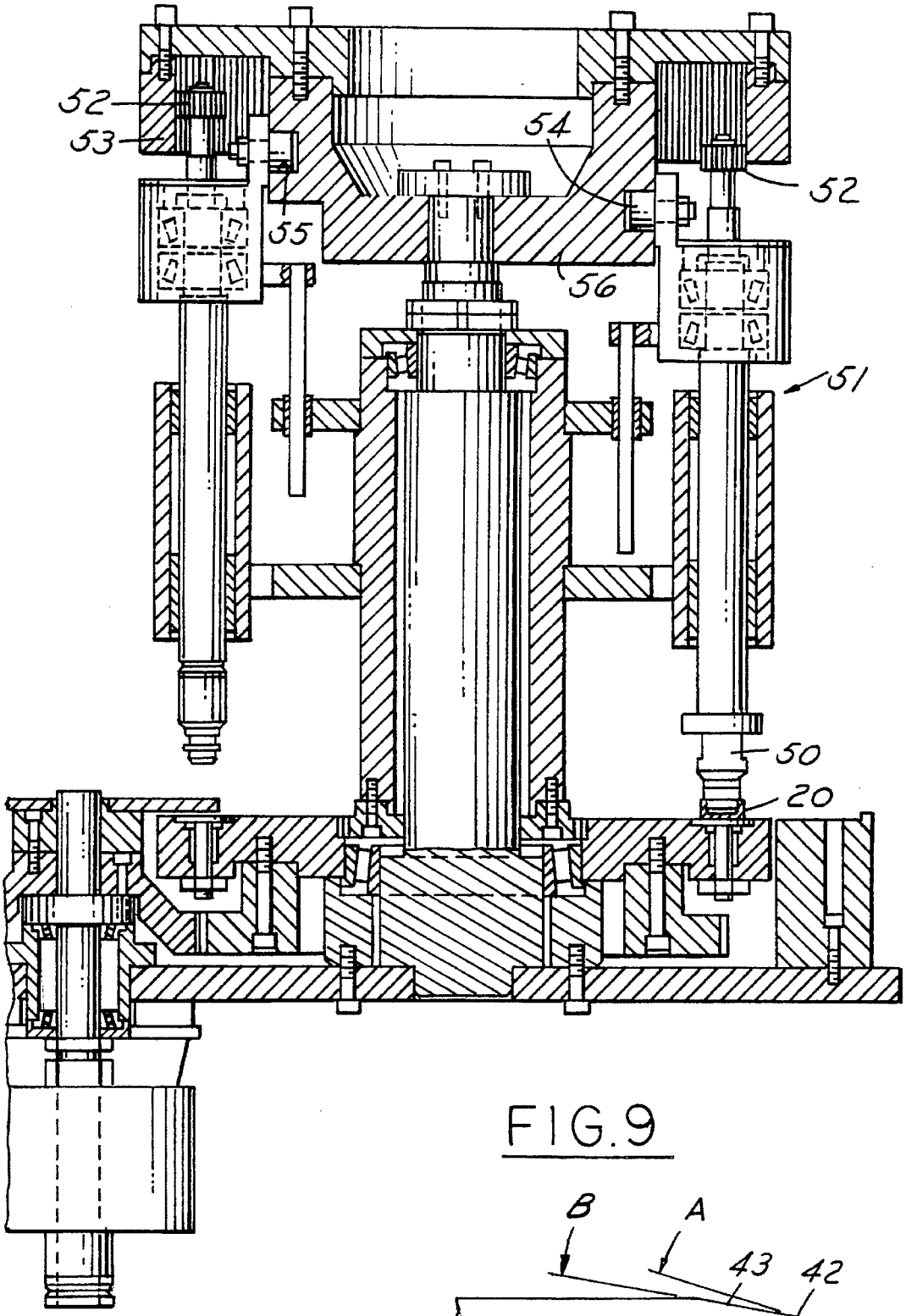
FIG. 11 is a fragmentary plan view of the apparatus taken along the line 11—11 in FIG. 10.

A typical apparatus for forming the closure is shown in FIGS. 10 and 11 and comprises a mandrel 50 on which the closure is mounted. The mandrel 50 is rotated as well as moved past the knives 35, 40 so that the primary knife 35 forms the preformed bridges **29*a* and the secondary knife 40 forms the final bridges 29**.

Preferably, the mandrel 50 is one of a plurality of mandrels 50 on a turret 51 and the turret 51 is rotated while the mandrels are being rotated about their axes providing a true rolling action of the closure past the knives 35, 40.

As shown in FIGS. 10 and 11, the mandrels 50 are mounted for rotation and vertical movement on the rotating turret 51. A pinion gear 52 on the upper end of each mandrel 50 engages an annular fixed internal gear sector 53. The mandrels 50 are moved vertically into and out of engagement with the inverted closures 20 by a cam follower 54 which follows an annular cam track 55 in a fixed cam above the turret 51.

As shown in FIG. 10, star wheels 57, 58 are provided for feeding and removing the closures 20 from the apparatus.

As further shown in FIG. 10, micrometer screws 59, 60 are provided for accurately positioning knives 35, 40 after which the mounting screws are tightened to lock the knives in adjusted position.

When the closures are moved in an annular path by the turret 51 with the knives 35, 40 positioned radially outwardly of the mandrels 50, the edges 36, 41 of the primary knife 35 and secondary knife 40 extend radially inwardly and are curved in a concave arc parallel to the path of travel of the mandrels 50.

Figure 12:
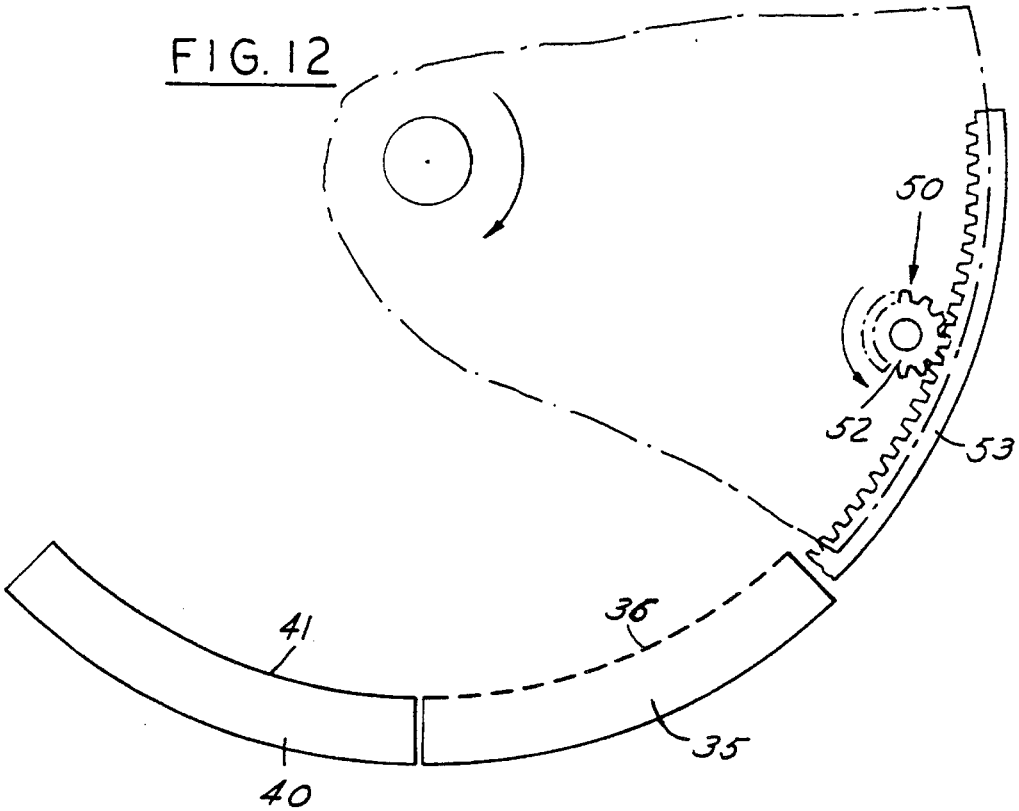
FIG. 12 is a diagram of the relative movements of the closure and knives.

As shown in the diagram, FIG. 12, in this arrangement, the turret 51 is rotating clockwise, as viewed from above, moving the mandrels 50 in a clockwise direction. As the mandrels 50 approach the knives 35, 40 the mandrels 50, and in turn the closures thereon, are rotated counterclockwise by engagement of the pinion gear 52 with the fixed internal gear 53. This provides the desired movement of the closures along the knives 35, 40 and the desired rolling action of the closures relative to the knives 35, 40.

Figure 13:
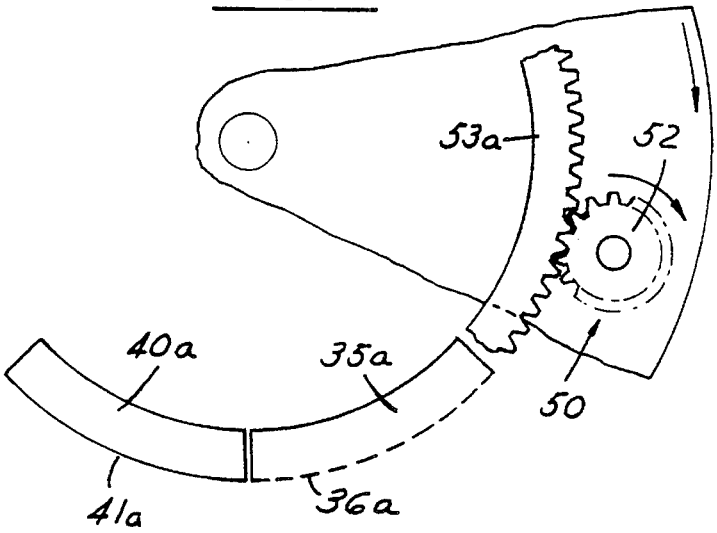
FIG. 13 is a diagram of the relative movements of the closure and knives of a modified method and apparatus.

Referring to the diagram shown in FIG. 13, if the knives **35*a*, 40*a* are positioned radially inwardly of the mandrels 50, the knives 35*a*, 40*a* have edges 36, 41*a* which extend radially outwardly and are reversed relative to FIG. 12. In addition, a fixed gear sector 53*a* having external teeth is positioned radially inwardly for engagement with the pinion gear 52. As a result, the mandrels 50 are rotated clockwise as well as revolved clockwise to obtain the desired movement of the closures along the knives 35*a*, 40*a* and the desired rolling action of the closures relative to the knives 35*a*, 40*a***.

Figure 14:
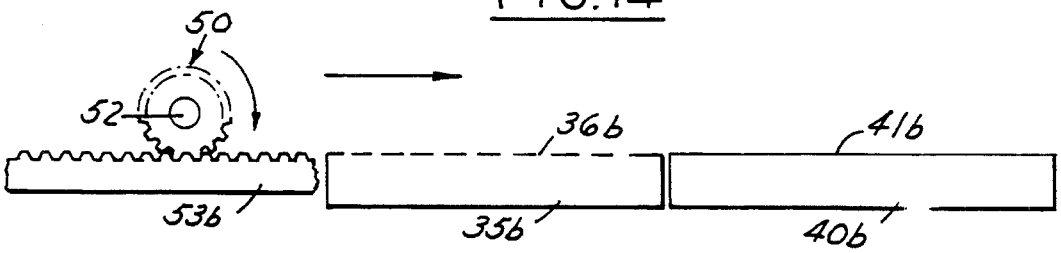
FIG. 14 is a diagram of the relative movements of the closure and knives of a further modified method and apparatus.

Referring to FIG. 14, if the mandrels 50 are moved in an endless path which has a straight portion along which the knives are successively positioned, the knives **35*b*, 40*b* have straight edges 36*b*, 41*b*. The gear sector is a straight fixed rack gear 53*b* that has teeth which engage the pinion gear 52 on the mandrels. As a result, the mandrels 50 are moved in a straight line past the successive knives 35*b*, 40*b* and the mandrels 50 are rotated clockwise to obtain the desired rolling action relative to the knives 35*b*, 40*b***.

It can thus be seen that there has been provided a tamper indicating closure on a molded plastic closure which does not require molded bridges; which can be made by relatively simple less costly molds; wherein the precise configuration of the bridges can be adjusted as desired; and wherein the bridges can be made at relatively high speeds and the desired configuration and strength of the bridges can be maintained; and wherein an improved method and apparatus insure accurately dimensional bridges.

I claim:

1. A method of forming a tamper indicating closure from a plastic closure having a base wall and a peripheral skirt comprising forming an interrupted circumferential score in the peripheral skirt of the closure to define a plurality of circumferentially spaced bridges, and providing an additional circumferential score in and along said interrupted circumferential score to reduce the thickness of the bridges to a predetermined amount, the step of forming the interrupted circumferential score comprising utilizing a primary knife having an interrupted cutting edge, the step of forming the additional circumferential score being provided by utilizing a secondary knife having a continuous cutting edge.

2. The method set forth in claim 1 including the step of moving the closure successively past said knives while rotating the closure such that the closure moves relatively along said knives and simultaneously is in rolling cutting contact with the knives.

3. The method set forth in claim 2 wherein said knives successively engage said closure from the periphery and extend radially inwardly through the closure.

4. The method set forth in claim 3 including the step of moving said closure in an arcuate path past said knives, wherein said cutting edges of said primary and secondary knives are arcuate.

5. The method set forth in claim 4 including the steps of positioning said knives radially outwardly of said arcuate path of said closure, providing said cutting edges on said knives which are concave and rotating said closure as it is moved into engagement with said knives in a direction opposite to the movement in said arcuate path such that the closure has a rolling action relative to said knives.

6. The method set forth in claim 4 including the steps of positioning said knives radially inwardly of the arcuate oath of said closure, providing said cutting edges on said knives which are convex and rotating said closure, as it is moved into engagement with said knives in the same direction as the movement in said arcuate path such that the closure has a rolling action relative to said knives.

7. The method set forth in claim 3 wherein said closure is moved in a straight path past said knives, wherein said cutting edges of said primary and secondary knives are straight.

8. The method set forth in any one of claims 6 including successively moving closures in a path past said primary and secondary knives.

* * * * *